US008381412B2

(12) United States Patent
Ahn et al.

(10) Patent No.: US 8,381,412 B2
(45) Date of Patent: Feb. 26, 2013

(54) DRYER AND METHOD OF REMOVING FOREIGN SUBSTANCE IN DRYER

(75) Inventors: Seung Phyo Ahn, Changwon (KR); Jeong Yun Kim, Changwon (KR); Sang Ik Lee, Changwon (KR)

(73) Assignee: LG Electronics Inc., Seoul (KR)

( * ) Notice: Subject to any disclaimer, the term of this patent is extended or adjusted under 35 U.S.C. 154(b) by 386 days.

(21) Appl. No.: 12/640,200

(22) Filed: Dec. 17, 2009

(65) Prior Publication Data

US 2010/0146812 A1 Jun. 17, 2010

(30) Foreign Application Priority Data

Dec. 17, 2008 (KR) ..... 10-2008-0128605

(51) Int. Cl.
*F26B 21/06* (2006.01)
*F26B 19/00* (2006.01)
*F26B 3/00* (2006.01)
*F26B 25/06* (2006.01)

(52) U.S. Cl. ..... 34/82; 34/85; 34/480; 34/667

(58) Field of Classification Search ..... 34/32, 82, 34/85, 292, 480, 587, 591, 667
See application file for complete search history.

(56) References Cited

U.S. PATENT DOCUMENTS

| | | | | |
|---|---|---|---|---|
| 2,422,825 | A * | 6/1947 | Davis, Jr. | 34/82 |
| 3,579,851 | A * | 5/1971 | Elmy | 34/82 |
| 3,612,616 | A * | 10/1971 | Stewart | 406/172 |
| 4,700,492 | A * | 10/1987 | Werner et al. | 34/403 |
| 6,024,536 | A * | 2/2000 | Tsubakida et al. | 416/189 |
| 7,677,964 | B1 * | 3/2010 | Bucher et al. | 454/356 |

FOREIGN PATENT DOCUMENTS

| | | |
|---|---|---|
| EP | 1645674 | 4/2006 |
| KR | 10-0651856 B1 | 12/2006 |

OTHER PUBLICATIONS

Korean Notice of Allowance dated Sep. 20, 2011 issued in Application No. 10-2008-0128605.

* cited by examiner

*Primary Examiner* — Kenneth Rinehart
*Assistant Examiner* — John McCormack
(74) *Attorney, Agent, or Firm* — KED & Associates LLP

(57) ABSTRACT

A dryer is provided, in which foreign substances contained in air circulating through an inside of a drum is filtered by a filter unit, and the foreign substances attached to the filter unit are separated by air flowing in a direction opposite to a flow direction of the circulating air. The separated foreign substances are collected in a separate lint case.

26 Claims, 7 Drawing Sheets

DRYER AND METHOD OF REMOVING FOREIGN SUBSTANCE IN DRYER

CROSS-REFERENCE TO RELATED APPLICATIONS

The present application claims the benefits of priority to Korean Patent Application No. 10-2008-0128605 (filed on Dec. 17, 2008), which is hereby incorporated by reference in its entirety.

BACKGROUND

The present disclosure relates to a dryer and a method of removing foreign substances in the dryer.

Generally, dryers are devices that a hot wind generated by a heater blows into a rotary drum to absorb moisture of an object (e.g., washed clothes) to be dried (hereinafter, referred to as a "dry object"), thereby drying the dry object.

Such a dryer is classified into a vented dryer and a condenser dryer according to a method of drying the dry object. In detail, the vented dryer uses a method in which moist air exhausted from a drum is exhausted to the outside of the dryer. The condenser dryer uses a recycling method in which moist air exhausted from a drum is condensed in a heat-exchanger to remove moisture, and then, the dry air is heated again to return to the drum.

Since the drum is a rotary type, the dry object received into the drum is shaken within the drum due to the rotation of the drum. In this process, foreign substances contained in the dry object are spread into the air. That is, the foreign substances are contained in the air passing through the drum.

The foreign substances contained in the air may pass through the mechanical components of the dryer to cause a break down of the components. In addition, the foreign substances may be discharged to the outside of the dryer to harm user's health. Thus, the air passing through the dryer should pass through a filter to remove the foreign substances.

Generally, the filter is disposed at a front side of the drum to filter the foreign substances contained in the air passing through the drum. When the foreign substances are gathered over a predetermined level on the filter, filter cleaning is required because airflow interferes. Generally, the filter is detachably coupled to the dryer. After a drying process is finished, a user separates the filter from the dryer to clean the filter.

Particularly, since the foreign substances were contained in moist air and hold moisture, the foreign substances adhere to the filter with sweat. As the drying process is progressed, an amount of moisture contained in the air gradually decreases. As a result, the moist foreign substances are dried, and therefore, the dried foreign substances adhere to the filter. Thus, there is a limitation that user takes the trouble to neatly clean the filter because the user are strongly shaking out the foreign substances.

If the filter is lift in a state in which the foreign substances adhere thereto, since adequate wind quantity is not secured, the dryer may be overheated to cause a fire.

Thus, it is a troublesome that the filter cleaning should be more frequently performed to secure wind quantity and prevent a fire from occurring.

SUMMARY

Embodiments provide a dryer in which a filter is automatically cleaned to allow a user to dump only foreign substances separated from the filter and a method of removing the foreign substances in the dryer.

Embodiments also provide a dryer in which an amount of wind passing through a filter is maintained over a predetermined level to improve drying performance, and risk of fire is significantly reduced and a method of removing the foreign substances in the dryer.

In one embodiment, a dryer includes: a cabinet defining an outer appearance; a drum inside the cabinet, the drum receiving a dry object; a drum cover in which a throwing hole through which the dry object is thrown is defined, the drum cover supporting a front surface of the drum; a base on which a driving motor generating a driving force for rotating the drum is seated, the base being disposed below the drum; a filter unit within the drum cover, the filter unit filtering foreign substances contained in moist air exhausted from the drum; and a fan assembly generating airflow in a direction opposite to a flow direction of the moist air generated during a drying process to separate the foreign substances attached to the filter unit.

In another embodiment, a dryer includes: a cabinet defining an outer appearance; a drum inside the cabinet, the drum receiving a dry object; a drum cover in which a throwing hole through which the dry object is thrown is defined, the drum cover supporting a front surface of the drum; a base in which a passage along which moist air exhausted from the drum flows is disposed, the base being disposed below the drum; an air duct along which the moist air exhausted from the drum flows, the air duct extending downwardly from the drum cover; a filter unit inserted into the air duct, the filter unit filtering foreign substances contained in the moist air exhausted from the drum; and a lint case in which the foreign substances separated from the filter unit are collected, the lint case being detachably coupled to the cabinet.

In further another embodiment, a method of removing foreign substances in a dryer having a drum and a filter unit through which moist air exhausted from the drum passes, the method including: flowing the moist air within the drum in a direction in which the moist air passes through the filter unit; filtering the foreign substances contained in the moist air using the filter unit while the moist air flows; reverse-flowing air from the filter unit toward the drum; and separating the foreign substances attached to the filter unit using the reversely flowing air.

In the dryer and the method of removing the foreign substance in the dryer according to the embodiments, since the foreign substances adhering to the filter are automatically removed to improve convenience of use.

The details of one or more embodiments are set forth in the accompanying drawings and the description below. Other features will be apparent from the description and drawings, and from the claims.

DETAILED DESCRIPTION OF THE EMBODIMENTS

In the following detailed description of the preferred embodiments, reference is made to the accompanying drawings that form a part hereof, and in which is show by way of illustration specific embodiments in which the invention may be practiced. These embodiments are described in sufficient detail to enable those skilled in the art to practice the invention, and it is understood that other embodiments may be utilized and that logical structural, mechanical, electrical, and changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Reference will now be made in detail to the embodiments of the present disclosure, examples of which are illustrated in the accompanying drawings.

Figure 1:
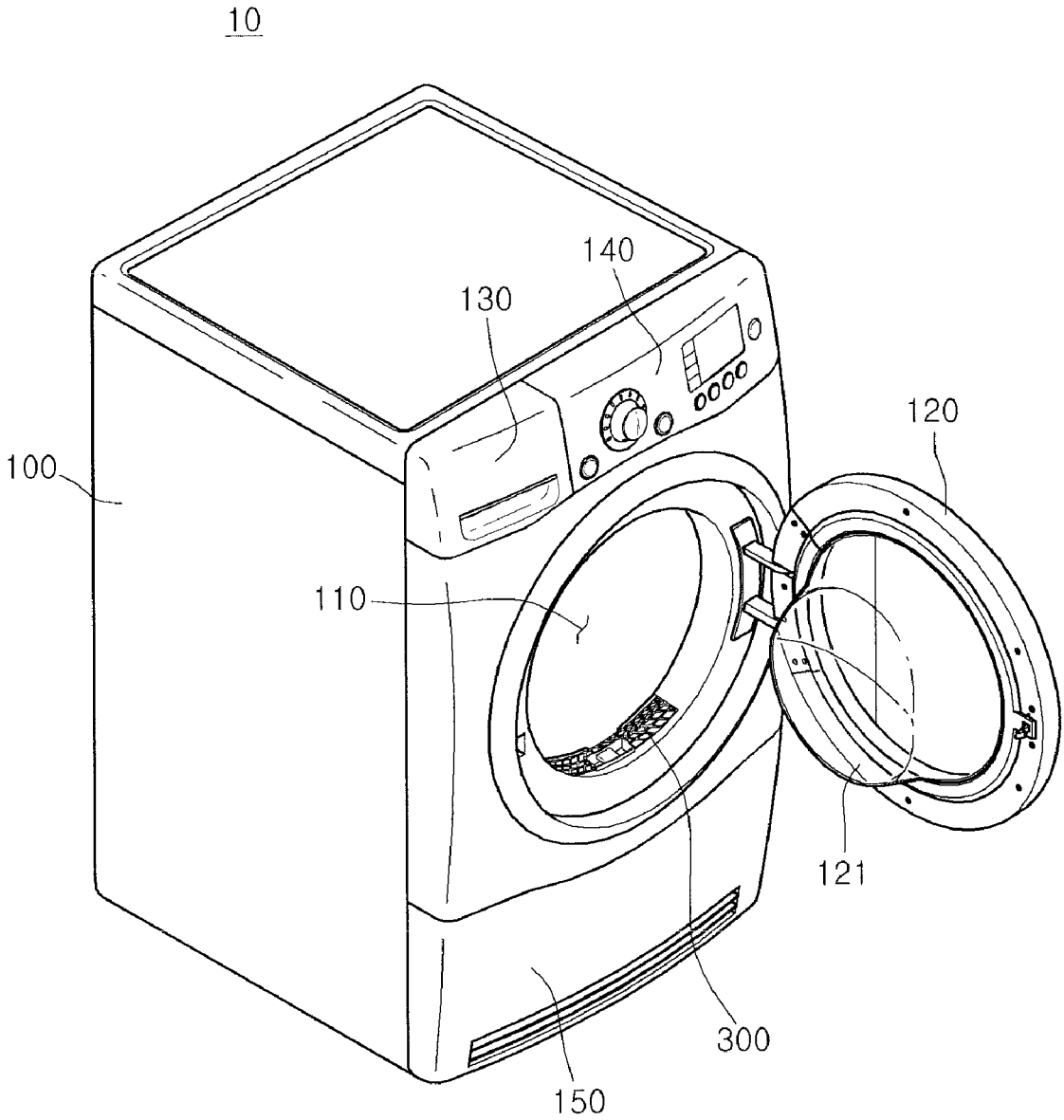
FIG. 1 is a perspective view illustrating an outer appearance of a dryer according to an embodiment.

FIG. 1 is a perspective view illustrating an outer appearance of a dryer according to an embodiment.

Hereinafter, for describing the spirit of the present disclosure, a condenser dryer will be described as an example. However, the spirit of the present disclosure is not limited to the condenser dryer, but is applicable to a vented dryer.

Referring to FIG. 1, a dryer 10 according to an embodiment includes a cabinet 100 defining an outer appearance and having an opening 110 in a front surface of a door 120 rotatably coupled to a side of the cabinet 100 and selectively covering the opening 110.

A drum (see reference numeral 200 of FIG. 2) for receiving dry objects such as clothes thrown through the opening 110 of the cabinet 100 is disposed inside the cabinet 100. Here, the dry objects contain a large amount of moisture.

A transparent window 121 may be disposed on a door 120 to confirm a dry condition by viewing the inside of the drum (see reference numeral 200 of FIG. 2) even through the door 120 is closed.

An operation part 140 is disposed on a side of the cabinet 100 to operate a drying cycle. A display and a plurality of buttons are disposed on the operation part 140 to allow a user to perform a desired drying cycle.

A drawer 130 is disposed in a front surface of the cabinet 110 to discharge condensed water generated during the drying process of the dry objects. Also, a lower cover 150 is detachably disposed on a lower portion of the front surface of the cabinet 100. The lower cover 150 prevents a heat exchanger (see reference numeral 260 of FIG. 2) for cooling air circulating the inside of the dryer 10 from being viewed from the outside. The user may separate the lower cover 150 from the cabinet 100, and then withdraw the heat exchanger 260 to clean the heat exchanger 260.

A filter unit 300 is disposed at a front side of the drum 200 to remove the foreign substances contained in the air passing through the drum 200. Hereinafter, specific descriptions related to an operation of the filter unit 300 will be described.

Figure 2:
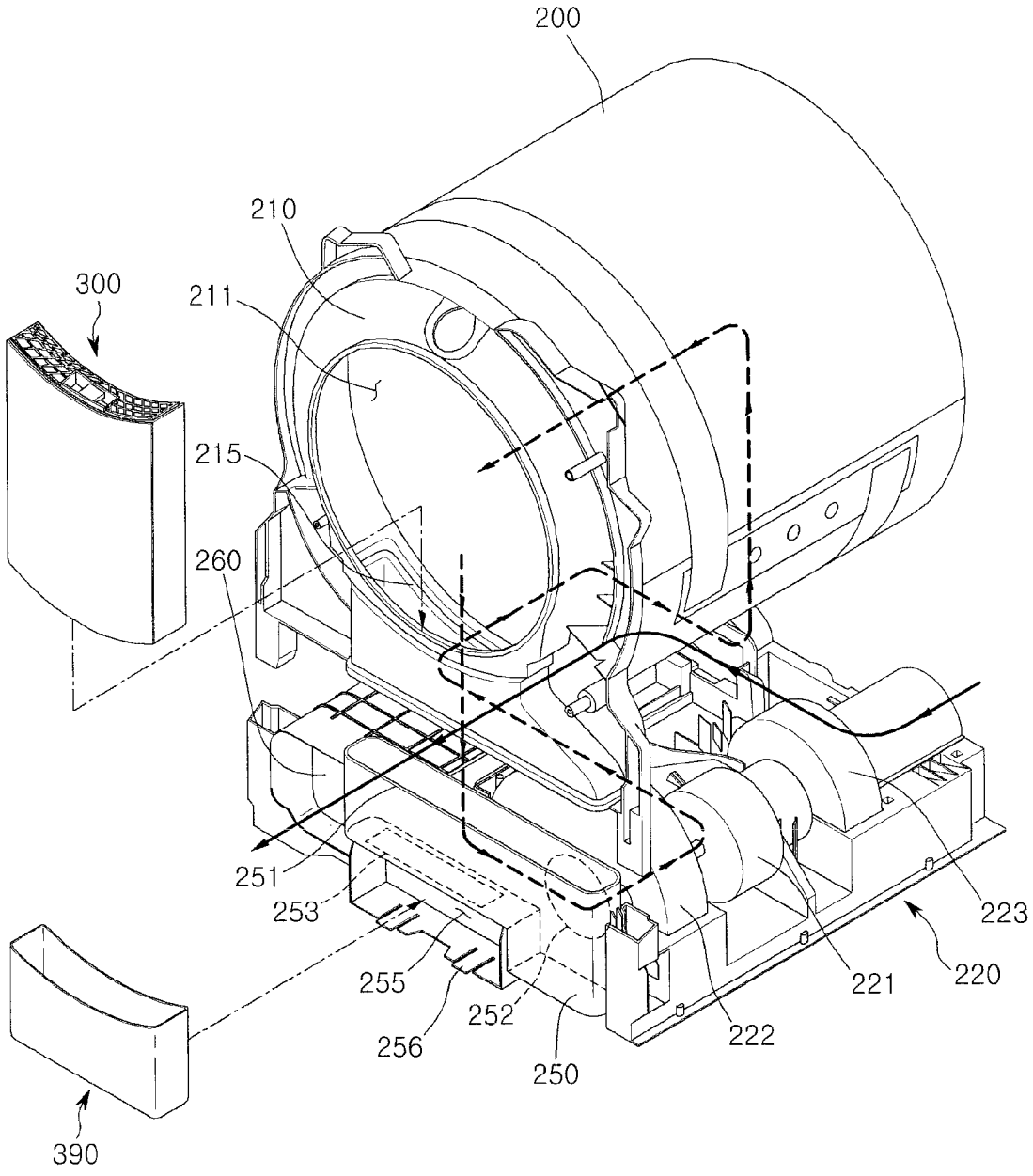
FIG. 2 is a perspective view illustrating main internal components of a dryer according to an embodiment.

FIG. 2 is a perspective view illustrating main internal components of a dryer according to an embodiment.

Referring to FIG. 2, the cabinet 100 includes the drum 200, a drum cover 210, a driving motor 221, and a base 220. The dry objects are received into the drum 200 and dried. Tire drum cover 210 is coupled to a front surface of the drum 200 to support the drum 200. The driving motor 221 is disposed below the drum 200 to rotate the drum 200. A blow fan 222 connected to the driving motor 221 to blow air into the drum 220 is disposed on the base 220.

In detail, the drum 200 has a cylindrical shape with opened front and rear surfaces. The front surface of the drum 200 is disposed toward the opening 110. Also, the front surface of the drum 200 is rotatably coupled to the drum cover 210. A felt may be disposed on the drum cover 210 contacting the drum 200 to smoothly rotate the drum 200.

The drum cover 210 supports the drum 200 and is coupled and installed to a front end of the base 220. A through hole 211 through which the dry objects are thrown is defined in the drum cover 210. Here, a portion of the drum cover 210 corresponding to the opening 110 and the front surface of the drum 200 is punched to define the through hole 211. That is, when the user opens the door 120 and then puts the dry objects through the opening 110, the dry objects pass through the through hole 211 and are received into the drum 200.

Also, an air duct 215 is disposed at a lower side of the through hole 211 to circulate the air passing through the drum 200. The air duct 215 has opened lower and upper sides through which the air passes. The lower side of the air duct 215 is connected to a housing (that will be described later) 250 disposed on the base 220. The filter unit 300 is disposed in the air duct 215 to filter the foreign substances. The operation of the filter unit 300 will be described later.

The base 220 defines a bottom surface of the dryer 10 and supports the drum cover 210 and the drum 200. In detail, the driving motor 221 for rotating the drum 200 is disposed on the base 220. The driving motor 221 is disposed at an approximately central portion of the base 220. The driving motor 221 is connected to the drum 200 using a belt (not shown) to rotate the drum 200.

The blow fan 222 for blowing the air into the drum 200 is disposed on the base 220. The blow fan 222 is connected to the driving motor 221 and rotated by the driving motor 221. The blow fan 222 is disposed forward the driving motor 221.

A cooling fan 223 connected to the driving motor 221 and rotated by the driving motor 221 to suck external air is disposed backward the driving motor 221. The external air sucked by the cooling fan 223 absorbs heat while passing through the heat exchanger 260.

A heater (not shown) for heating the air introduced into the drum 200 is disposed backward the drum 200.

The heat exchanger 260 is disposed at a side of the base 220 to heat-exchange between the circulation air discharged from the drum 200 and the air introduced from the outside of the dryer 10. The heat exchanger 260 is disposed withdrawable from a front side of the base 220. The user may withdraw the heat exchanger 260 to clean the heat exchanger 260. A specific operation of the heat exchanger 260 will be described later.

The housing 250 is detachably disposed on a front side of the base 220. The housing 250 is vertically disposed below the drum cover 210 and connected to a lower end of the air duct 215.

In detail, the housing 250 has an approximately rectangular parallelepiped shape. A depressed insertion groove 251 in which the filter unit 300 is inserted is defined in an upper end of the housing 250. The insertion groove 251 is connected to the lower end of the air duct 215. Thus, when the filter unit 300 is inserted into the air duct 215, a portion of the filter unit 300 is received into the insertion groove 251.

The insertion groove 251 extends up to a front side of the blow fan 222. A communication hole 252 is defined at a position corresponding to a suction part of the blow fan 222.

Thus, the air passing through the filter unit 300 is sucked into the blow fan 222 through the communication hole 252.

A lint case receiving part 255 to which a lint case 390 is detachably coupled is disposed below the housing 250. In detail, the lint case receiving part 255 may be disposed in the front surface of the base 220. A portion of the base 220 may be depressed to have a shape corresponding to that of the lint case, or a rib having a shape surrounding the lint case 390 may protrude from the front surface of the base 220 to form the lint case receiving part 255. A hook 256 may be disposed on a bottom surface of the lint case receiving part 255 to prevent the lint case 390 from being easily separated after the lint case 390 is coupled to the lint case receiving part 255. The lint case 390 has a basket shape with opened upper surface and is installed at the lint case receiving part 255.

A foreign substance dropping hole 253 is defined in a bottom surface of the housing 250 corresponding to a bottom surface of the filter unit 300 to receive the dropping foreign substances into the lint case 390. In detail, a foreign substance discharge hole is defined in the bottom surface of the filter unit 300, and the foreign substance dropping hole is disposed corresponding to the foreign substance discharge hole. Thus, the foreign substances separated from the filter unit 300 pass through the foreign substance discharge hole and the foreign substance dropping hole 253 and drop into the lint case 390. When the foreign substances stored in the lint case 390 exceed a predetermined level, the user may separate the lint case 390 to dump the foreign substances.

A portion of the filter unit 300 may protrude toward the inside of the foreign substance dropping hole 253. In this case, an inlet of the lint case 390 may be directly connected to the foreign substance discharge hole to securely prevent the foreign substances from leaking to the outside.

The housing 250 may cover portions of an inlet and outlet of the heat exchanger 260 to secure a size of the filter part 330 that will be described later. In this case, the lower cover may be firstly removed, and the housing 250 may be removed, and then, the heat exchanger 260 may be withdrawn.

Since the dry objects contain a large amount of moisture, the moisture contained in the dry objects is evaporated while the dry hot wind passes through the dry objects. This process is performed at the same time when the drum 200 is rotated. That is, the dry objects are dried while they are rotated together with the drum 200. At this time, the foreign substances such as dusts and naps contained in the dry objects are spread into the moist air within the drum 200. That is, the foreign substances are contained in the moist air passing through the drum 200. When the foreign substances are introduced into the blow fan 222, the blow fan 222 may be broken down. Thus, the foreign substances should be filtered before they pass through the blow fan 222.

Thus, the filter unit 300 is disposed in the drum cover 210 to filter the foreign substances contained in the air passing through the drum 200. In detail, the filter unit 300 is inserted downwardly from an upper side of the air duct 215. Also, a portion of the filter unit 300 is inserted into the insertion groove 251 of the housing 250.

At this time, air is introduced from an upper side of the filter unit 300, and the air in which the foreign substances are filtered is exhausted in a rear direction of the filter unit 300. Thus, a rear surface of the filter unit 300 may be spaced from the a back surface of the air duct 215 and a back surface of the housing 250 such that the air smoothly flows inside the drum cover 210 and the insertion groove 251. That is, the filter unit 300 may have a thickness in a front-rear direction less than that of the insertion groove 251.

Also, the filter unit 300 has a shape corresponding to that of the inlet (upper end) of the air duct 215 to prevent the foreign substances contained in the moist air from building up the neighborhood of the inlet of the air duct 215. That is, in a state where the filter unit 300 is inserted into the air duct 215, a top surface of the filter unit 300 has the same surface as a duct cover of the inlet of the air duct 215.

Hereinafter, airflow of the dryer 10 including the above-described components will be simply described.

The dryer 10 is a condenser dryer. Thus, air circulating inside the dryer 10 (see a dotted arrow of FIG. 2, and hereinafter, referred to as a circulation air) is cooled by air introduced from the outside of the dryer 10 (see a straight arrow of FIG. 2, and hereinafter, referred to as a cooling air).

In detail, with respect to the drum 200, the circulation air within the drum 200 includes a large amount of foreign substances containing moisture. The circulation air forwardly flows by the rotation of the blow fan 222. That is, the blow fan 222 generates a suction flow to suck the circulation air toward the blow fan 222. The circulation air exhausted from the drum 200 passes through the filter unit 300 disposed in the air duct 215. In this process, the foreign substances are filtered by the filter part 330 that will be described later.

The circulation air passing through the filter unit 300 flows toward the heat exchanger 260 through the blow fan 222. Then, the circulation air heat-exchanges with the cooling air in the heat exchanger 260 and thus is cooled. At this time, since the circulation air contains moisture, condensed water is generated when the circulation air is cooled. The condensed water flows toward the drawer 130 and then is discharged. Here, the condensed water generated in the heat exchanger 260 may flow toward a separate condensed water storage part (not shown) disposed at a side of the base 220, and a pump (not shown) may be disposed in the condensed water storage part. A condensing hose (not shown) may extend from the pump and be connected to a back surface of the drawer 130. Thus, the condensed water generated in the heat exchanger 260 flows toward the drawer 130 and then is stored in the drawer 130. Thereafter, the user may separate the drawer 130 to dump the stored condensed water.

The cooled circulation air flows in a rear direction of the base 220. Then, the cooled circulation air is heated at a high temperature while it flows along a passage defined in a rear side of the drum 200. Also, the cooled circulation air is introduced into the drum 200 from a rear direction of the drum 200 to circulate inside the dryer 10. Here, a dry duct (not shown) may be disposed on a rear surface of the cabinet 100 corresponding to a rear surface of the drum 200. An inlet of the dry duct may be connected to an exhaust hole of the circulation air. The exhaust hole of the circulation air may be connected to the rear surface of the drum 200. The heater may be disposed inside the dry duct.

The cooling air is sucked into the base 220 from a rear side of the dryer 10 by the rotation of the blow fan 223. The cooling air flows toward the heat exchanger 260 along the passage defined in the base 220 to absorb heat of the circulation air. The cooling air absorbing the heat while passing through the heat exchanger 260 is exhausted in a front or side direction of the dryer 10.

According to the above-described process, the foreign substances filtered by the filter unit 300 are automatically separated from the filter and stored in the lint case 390.

Hereinafter, a structure and operation of the filter unit 300 will be described in detail with reference to accompanying drawings.

Figure 3:
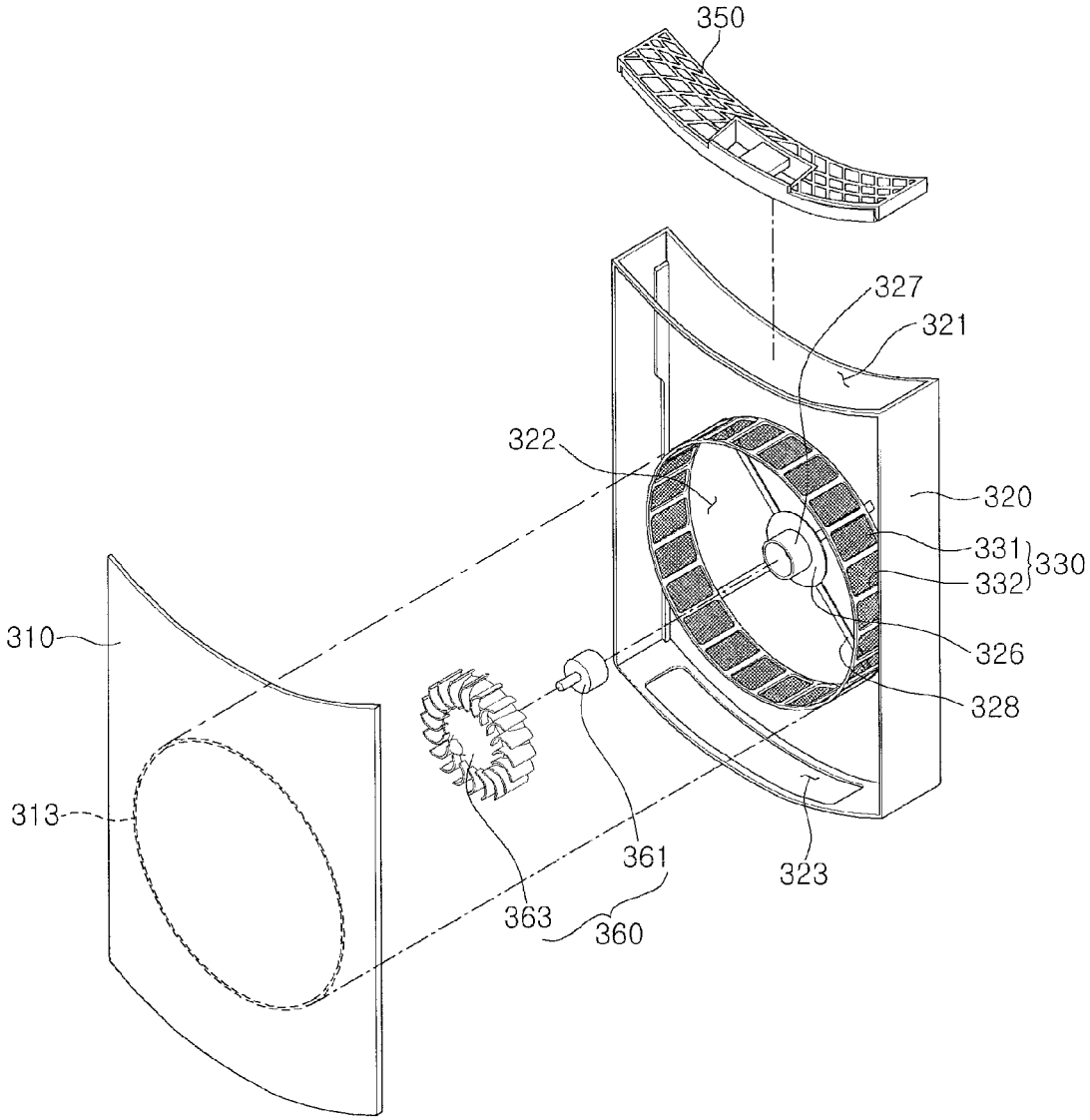
FIG. 3 is an exploded perspective view illustrating a filter unit of FIG. 2.
Figure 4:
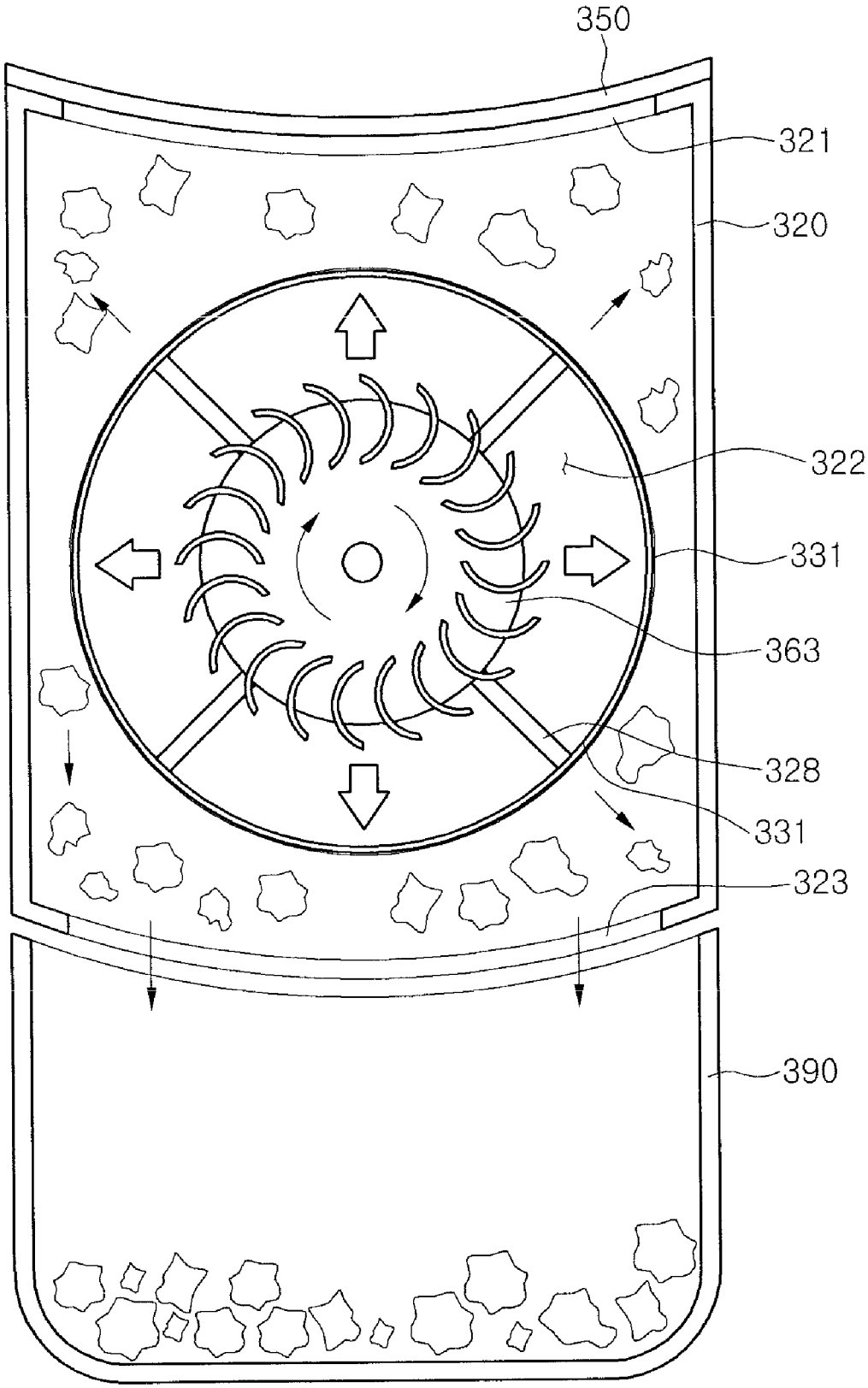
FIG. 4 is a view illustrating a process in which foreign substances filtered by a filter unit of FIG. 2 are separated.

FIG. 3 is an exploded perspective view illustrating a filter unit of FIG. 2, and FIG. 4 is a view illustrating a process in which foreign substances filtered by a filter unit of FIG. 2 are separated.

Referring to FIGS. 3 and 4, the filter unit 300 includes a front cover 310 defining a front surface thereof, a filter case 320 coupled to the front cover 310, a filter part 330 disposed inside the filter case 320 and having a tubular shape, and a fan assembly 360 for blowing air toward the filter part 330. The filter case 320 includes an air inlet 321 through which the air exhausted from the drum 220 is introduced, an air outlet 322 through which the air sucked into the air inlet 321 is exhausted, and the foreign substance discharge hole 323 through which the foreign substances filtered by the filter part 330 are discharged.

The filter part 330 has a tubular shape with a predetermined diameter and length. Also, the filter part 330 has opened front and rear surfaces. In detail, the filter part 330 includes a filter frame 332 having a circular belt shape and a filter 331 disposed on the filter frame 332 and having a mesh shape. A width of the filter frame 332 is determined by a width in a front-rear direction of the filter case 320. The air outlet 322 defined in a back surface of the filter case 320 has the same diameter as that of the filter part 330. That is, the air introduced through the air inlet 321 passes through the filter 331 and flows toward the air outlet 322. Since the air outlet has a circular shape in this embodiment, the filter part 330 has a tubular shape. The filter frame 332 has the substantial same width as that in the front-rear direction of the filter case 320.

In detail, a plurality of ribs is arranged with a predetermined distance therebetween on the filter frame 332 in a longitudinal direction of a cylinder. The filter 331 surrounds an inner circumference surface (or outer circumference surface) of the filter frame 332. Thus, air is sucked through a space defined between the ribs, and the foreign substances are filtered by the filter 331 disposed between the ribs.

The air inlet 321 is defined in an upper surface of the filter case 320 and rounded with a predetermined curvature corresponding to a curvature of the throwing hole 211. Also, a grille 350 is coupled to an upper portion of the air inlet 321 to prevent the dry objects from being introduced into the filter unit 300.

At this time, the front cover 310 and the filter case 320 may be integrally formed with each other using injection molding. Also, the air inlet 321 and the air outlet 322 may be exchanged in position with each other. Such a position exchange in the design can be easily made therefrom by those skilled in the art without departing form the spirit of the present disclosure.

Here, when the filter unit 300 is inserted into the drum cover 210, the front cover 310 is inserted facing a front side, and the filter case 320 is inserted facing a rear side. That is, the air exhausted from the drum 200 is introduced into the air inlet 321 through the grille 350, and the air passing through the filter part 330 is exhausted through the air outlet 322. That is, the air passing through the filter part 330 is exhausted toward a rear side of the filter unit 300.

At this time, to smoothly exhaust the air, the back surface of the filter case 320 in which the air inlet 321 is defined may be spaced a predetermined distance from the back surface of the housing 250. For example, a rear surface of the filter case 320 may be forwardly inclined at a predetermined angle as moving toward a lower end thereof. In this case, it prevents the air exhausted from the drum 200 from leaking to the outside of the filter unit 300. That is, the grille 350 may be closely attached to the air duct 215 and the air inlet 321. Substantially, the grille 350 may have the same surface as an inner circumference surface of the throwing hole 211. When the back surface of the filter case 320 is forwardly inclined as moving toward the lower end thereof, and the air outlet 322 is spaced from the back surface of the housing 250 as moving toward a lower side thereof. Thus, a suction force of the blow fan 222 may be smoothly operated.

A fan assembly support 326 is disposed on the back surface of the filter case 320. The fan assembly support 326 is supported by a support rib 328 extending from a circumference of the air outlet 322 toward a center of the air outlet 322. The fan assembly support 326 is disposed on an approximately central portion of the air outlet 322. Also, the fan assembly support 326 supports a motor support 327 to fix the fan assembly 360 to the center of the air outlet 322. The motor support 327 protrudes from the fan assembly support 326 toward the front cover 310. A central portion of the motor support 327 is depressed such that a fan motor 361 is inserted.

The fan assembly 360 includes the fan motor 361 and a centrifugal fan 363 rotated by the fan motor 361.

In detail, the fan motor 361 is fixed to the motor support 327. At this time, the fan motor 361 is installed such that a rotation shaft thereof extends toward a direction perpendicular to the front cover 310. The centrifugal fan 363 is coupled to the fan motor 361.

When the fan motor 361 is operated to rotate the centrifugal fan 363, air within the filter part 330 blows in a radius direction of the centrifugal fan 363. Specific descriptions related to an operation of the fan motor 361 will be described later.

The fan assembly support 326 may have an external diameter less than that of the centrifugal fan 363 such that the air passing through the centrifugal fan 363 smoothly flows.

In addition, a shield part 313 having a circular shape corresponding to that of the filter frame 332 protrudes from the back surface of the front cover 310 and is closely attached to a front surface of the filter frame 332. Thus, the air introduced through the air inlet 321 passes through the filter part 330, and then is exhausted through the air outlet 322.

The foreign substance discharge hole 323 is defined in a bottom surface of the filter case 320 such that the foreign substances drop into the lint case 390.

Hereinafter, functions of the filter part 330 and the fan assembly 360 will be described.

The air introduced into the air inlet 321 passes through the filter part 330 and is exhausted through the air outlet 322. In this process, the foreign substances are filtered by the filter part 330. In detail, since the shield part 313 is connected to the filter frame 332, the air must pass through the filter 331. Thus, the foreign substances are filtered by the filter 331. At this time, a portion at which the foreign substances are filtered may be an outer surface of the filter 331.

The air introduced into the filter unit 300 irregularly flows before the air passes through the filter part 330. Thus, the foreign substances are filtered at an upper end of the filter part 330 as well as an entire region of the filter part 330.

After the drying process is finished, when a voltage is applied to the fan motor 361, the centrifugal fan 363 is rotated. The centrifugal fan 363 draws air in a rotation axis and exhausts the air in a radius direction. That is, when the centrifugal fan 363 is rotated, the air is sucked through the air outlet 322, and then exhausted in the radius direction. Thus, the foreign substances filtered on the outer surface of the filter part 330 are separated from the filter 331 due to wind generated by the centrifugal fan 363. The foreign substances separated from the filter 331 drop by gravity and are stored into the lint case 390 through the foreign substances discharge hole 323. Here, the centrifugal fan 363 should be minimally operated such that a flow of the air circulating inside the dryer 10 does not interfere.

Also, the centrifugal fan 363 may be operated after the drying process is finished such that the flow of the air circulating inside the dryer 10 does not interfere. In this case, the centrifugal fan 363 should be rotated at a high speed to smoothly separate the foreign substances. When the foreign substance separation process is performed after the drying process is finished, the centrifugal fan 363 may be sufficiently rotated at the high speed.

A process in which the foreign substances are removed in the dryer including the above-described components according to this embodiment will be described.

The foreign substance removing process is performed after the drying process is finished. In detail, in a state where the drying process is finished, the fan motor 361 is operated to rotate the centrifugal fan 363. As a result, in the drying process, airflow is generated in a direction opposite to the flow direction of the circulation air. That is, the air is sucked through the air outlet 322 of the filter case 320, and then is sucked in the axis direction of the centrifugal fan 363. The air collides with the filter part 330 while the air is exhausted in the radius direction of the centrifugal fan 363. As a result, the foreign substances attached to the filter part 330 are separated, and the separated foreign substances drop into the bottom of the filter case 320. The dropping foreign substances are collected into the lint case 390 through the foreign substances discharge hole 323.

Hereinafter, a filter unit of a dryer according to another embodiment will be described with reference to accompanying drawings. Since this embodiment is equal to the previously described embodiment except that a guide is provided, portions different from the previously described embodiment will mainly be described, and the same portions as the previously described embodiment will be denoted as the same descriptions and reference numerals.

Figure 5:
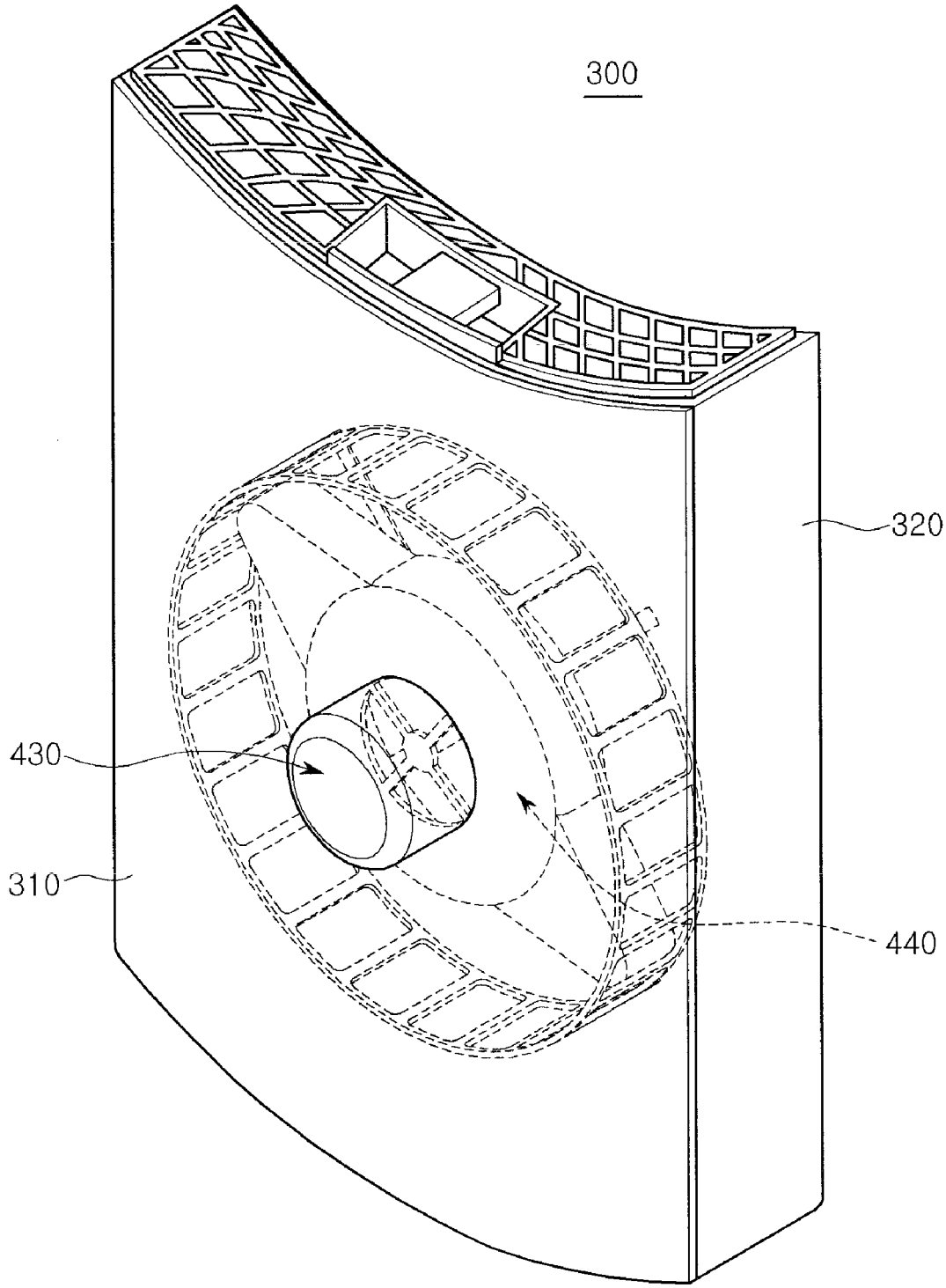
FIG. 5 is a perspective view illustrating an outer appearance of a filter unit of a dryer according to another embodiment.
Figure 6:
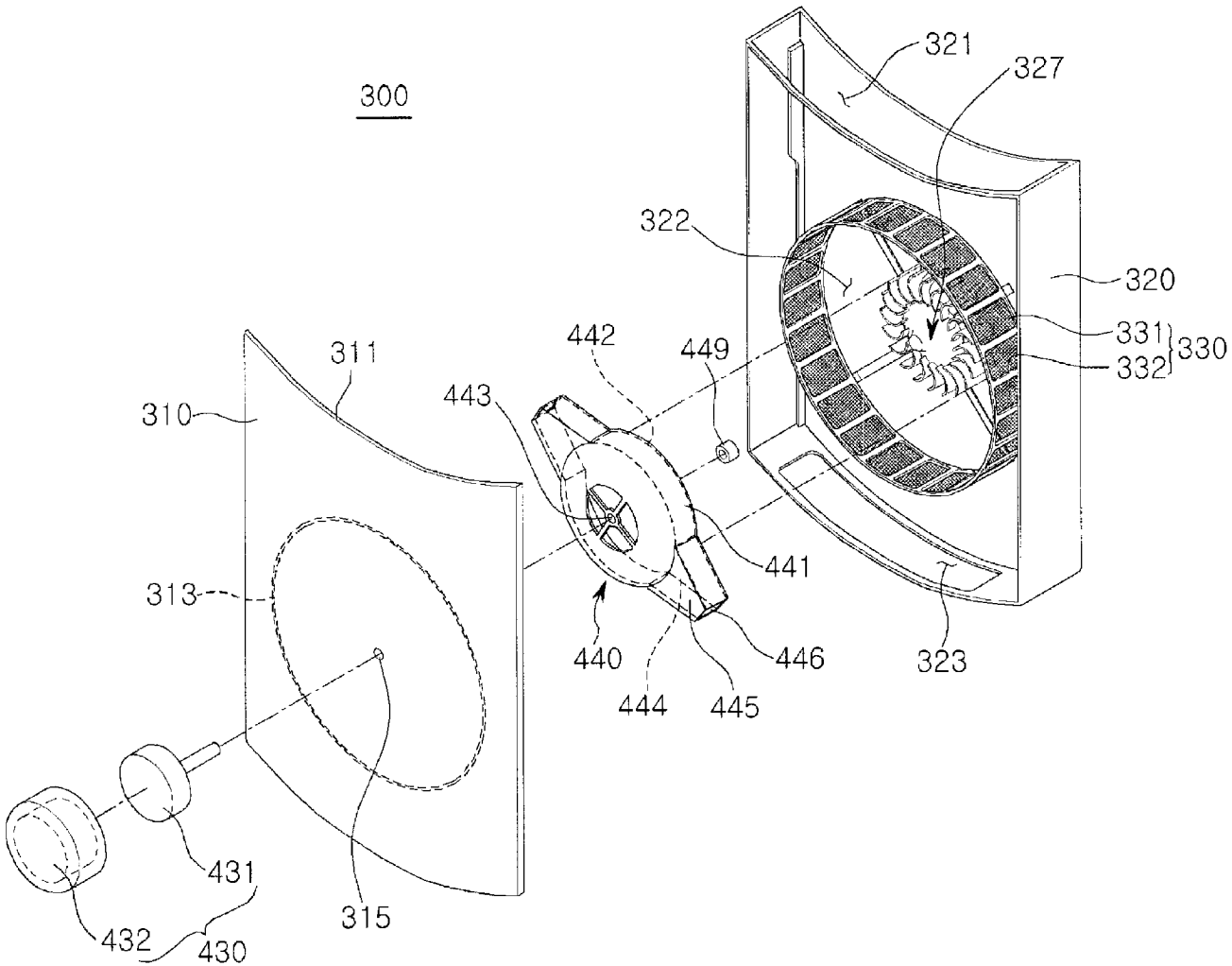
FIG. 6 is an exploded perspective view illustrating the filter unit of FIG. 5.

FIG. 5 is a perspective view illustrating an outer appearance of a filter unit of a dryer according to another embodiment, and FIG. 6 is an exploded perspective view illustrating the filter unit of FIG. 5.

Referring to FIGS. 5 and 6, a filter unit 300 of a dryer according to this embodiment includes a guide 440 concentrating wind into one point and a guide rotation part 430 rotating the guide 440.

In detail, the guide 440 includes a guide body 441 surrounding a centrifugal fan 363 and an arm 445 extending from the guide body 441 in a radius direction.

The guide body 441 has an inwardly depressed cylindrical shape and covers the centrifugal fan 363. That is, a depressed centrifugal fan receiving part 442 is defined inside the guide body 441 to receive the centrifugal fan 363.

The arm 445 extends from a circumference of the guide body 441 in the radius direction by a length near to a filter part 330. An air exhaust hole 446 through which air is exhausted is defined in an end of the arm 445. Here, since the arm 445 has a nozzle shape having a width gradually decreasing toward the end thereof, a pressure of the air exhausted through the air exhaust hole 446 may increase. A width in a front-rear direction of the air exhaust hole 446 may correspond to a width of a filter frame 332. Thus, the wind may be uniformly spread onto an entire filter 331 while the guide 440 is rotated. In addition, a guide passage 444 connected to the centrifugal fan receiving part 442 is disposed inside the arm 445 to exhaust the air through the air exhaust hole 446.

Thus, when the centrifugal fan 363 is operated, the air exhausted in the radius direction flows along an inner circumference surface of the guide body 441 and is exhausted through the arm 445. That is, since the wind generated by the centrifugal fan 363 is exhausted through the air exhaust hole 446, the wind may be concentrated into a specific point. Thus, foreign substances filtered by a filter 331 may be further effectively separated.

The guide 440 is connected to the guide rotation part 430 disposed on a front cover 310, and thus rotated by the guide rotation part 430.

In detail, the guide rotation part 430 includes a guide rotation motor 431 rotating the guide 440 and a motor fixing part 432 fixing the guide rotation motor 431 to the front cover 310. A rotation shaft hole 315 is defined in the front cover 310. A rotation shaft of the guide rotation motor 431 passes through the front cover 310 and is connected to the guide 430. Also, a hole 443 is defined in the guide body 441 to allow the rotation shaft of the guide rotation motor 431 to pass through the hole 443. A fixture 449 is fitted into an end of the rotation shaft of the motor 431 at a rear side of the centrifugal fan receiving part 442. As a result, the guide 440 may be rotatable in a state where the guide 440 is supported by the front cover 310.

According to the above-described components, the guide 440 is rotated inside the filter part 330. Thus, since the air is exhausted through the air exhaust hole 446 while the air exhaust hole 446 through which the wind is mainly exhausted is rotated along an inner circumference surface of the filter part 330, the foreign substances filtered by the filter part 330 may be surely removed. Of cause, the foreign substance removing process is performed after a drying process is performed.

Hereinafter, a filter unit of a dryer according to another embodiment will be described with reference to an accompanying drawing.

This embodiment is different from the previously described embodiments in that a fan assembly for removing foreign substances is not separately provided to a filter unit and a foreign substance removing process is performed by a reversed rotation of a blow fan for circulating air within a drum during a drying process.

Figure 7:
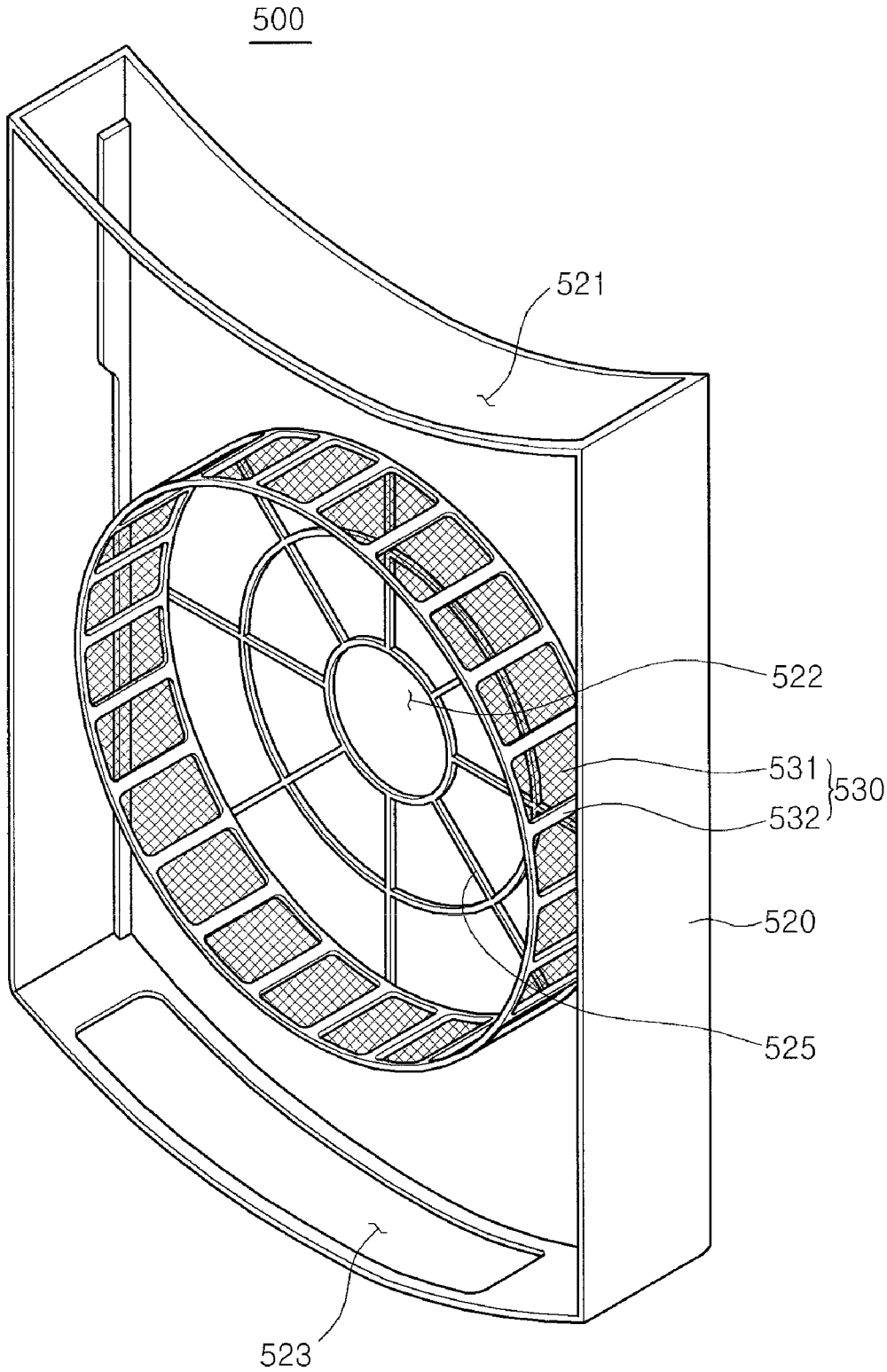
FIG. 7 is a view illustrating a filter part of a dryer according to another embodiment.

FIG. 7 is a view illustrating a filter part of a dryer according to another embodiment.

Referring to FIG. 7, a filter unit 500 of a dryer according to another embodiment includes a filter case 520 and a front cover (not shown), like the previously described embodiments.

In detail, an air inlet 521, air outlet 522, and a foreign substance discharge hole 523 are defined in the filter case 520. A filter part 530 includes a filter 531 filtering foreign substances and a filter frame 532 supporting the filter 531.

A plurality of support ribs 525 radially extends inside the air outlet 522. However, the support ribs 525 may not be provided. From the viewpoint of airflow, it may be further advantageous that the support ribs 525 are not provided. However, to reinforce strength of the filter case 520, it may be necessary to provide the support ribs 525. A front surface of the filter part 530 may be supported by a circular-shaped rib protruding from a back surface of the front cover. Also, the circular-shaped rib may forwardly protrude along a circumference of the air outlet 522. A back surface of the filter part 530 may be supported by the circular-shaped rib. According to a foreign substance removing process in the dryer including the above-described components, after a drying process is completely finished, a driving motor 221 is reversely rotated to rotate a blow fan 222 in a direction opposite to a rotation direction during the drying process. At this time, a clutch may be provided such that only the blow fan 222 is reversely rotated, and the drum 200 is not rotated.

When the blow fan 222 is reversely rotated, air is introduced into the filter unit 300 through the air outlet 522. That is, the air flows from the inside of the filter part 530 toward the outside. Thus, the foreign substances attached to outer surface of the filter 531 may be separated from the filter 531. The foreign substances separated from the filter 531 drop into and are stored in a lint case 390.

According to the dryer 10 and the filter unit 300 of the embodiments, the foreign substances adhering to the filter 331 may be automatically and easily removed to improve convenience of use. In addition, a filter cleaning cycle may increase to improve the convenience of use.

Also, it may be not required to clean the filter 331 whenever the dryer 10 is utilized. This is done because only the lint case 390 is separated to dump the foreign substances. Therefore, the convenience of use may be maximized.

Also, in case where the filter 331 or 531 is automatically cleaned, since an amount of wind passing through the inside of the drum 200 may be maintained over a predetermined level, risk of fire may be significantly reduced.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dryer, comprising:

a cabinet that defines an outer appearance of the dryer;

a drum inside the cabinet, the drum being configured to receive an object to be dried;

a drum cover having a hole through which the object is received, the drum cover supporting a front surface of the drum;

a base, on which a driving motor that generates a driving force to rotate the drum is seated, the base being disposed below the drum;

a filter unit within the drum cover, that filters foreign substances contained in moist air exhausted from the drum;

a fan assembly that generates airflow in a direction opposite to a flow direction of the moist air generated during a drying process to separate the foreign substances attached to the filter unit, the fan assembly comprising a fan disposed within the filter unit that generates the airflow and a fan motor that rotates the fan;

a guide that receives the fan at a front side of the fan, the guide allowing the airflow generated by the fan to be exhausted in a predetermined direction; and a guide rotation part that rotates the guide.

2. The dryer according to claim 1, further comprising:

an air duct that extends downwardly from a bottom of a surface defining the hole; and a grille seated on an inlet of the air duct, wherein the moist air within the drum is exhausted through the air duct during the drying process.

3. The dryer according to claim 2, wherein the filter unit is inserted into the air duct.

4. The dryer according to claim 1, wherein the filter unit comprises:

a filter case comprising an air inlet defined in an upper side thereof, an air outlet defined in a back surface thereof, and a foreign substance discharge hole defined in a lower side thereof;

a front cover that defines a front surface of the filter case; and a filter part within the filter case, the filter part having a tubular shape with an empty space therein.

5. The dryer according to claim 4, wherein the filter part comprises:

a filter frame having a predetermined width and wound into a tubular shape; and a filter attached to the filter frame.

6. The dryer according to claim 4, wherein the filter part is fixed between a back surface of the filter case and the front cover.

7. The dryer according to claim 4, wherein the front cover and the filter case are coupled to each other as separate parts or integrated as one unitary body.

8. The dryer according to claim 4, wherein a shield part having a shape corresponding to an outer appearance of the filter part protrudes from a back surface of the front cover.

9. The dryer according to claim 1, further comprising:

a rib that radially extends from an edge portion of the air outlet in a central direction; and a motor support fixed to an end of the rib, wherein the fan assembly is disposed at a center of the filter part by the motor support.

10. The dryer according to claim 1, wherein the fan comprises a centrifugal fan.

11. The dryer according to claim 1, wherein the guide comprises:

a guide body that covers the fan; and an arm in which an exhaust hole is defined in an end thereof, the arm radially extending from the guide body.

12. The dryer according to claim 11, wherein the arm extends into a shape having a width gradually decreasing toward the end thereof.

13. The dryer according to claim 11, wherein the end of the arm has a nozzle shape.

14. The dryer according to claim 1, wherein the guide rotation part comprises:

a guide rotation motor in which a rotation shaft thereof is connected to a center of the guide; and a motor fixing part that fixes the guide rotation motor to the front cover.

15. A dryer, comprising:

a cabinet that defines an outer appearance of the dryer;

a drum inside the cabinet, the drum being configured to receive an object to be dried;

a drum cover having a hole through which the object is received, the drum cover supporting a front surface of the drum;

a base, in which a passage along which moist air exhausted from the drum flows is disposed, the base being disposed below the drum;

an air duct along which the moist air exhausted from the drum flows, the air duct extending downwardly from the drum cover;

a filter unit inserted into the air duct, the filter unit filtering foreign substances contained in the moist air exhausted from the drum; and a lint case in which the foreign substances separated from the filter unit are collected, the lint case being detachably coupled to the cabinet, wherein the filter unit comprises:

a filter case detachably coupled to the drum cover;

a plurality of holes in the filter case including an air inlet, an air outlet, and a foreign substance discharge hole; and a filter part including a filter and a filter frame, the filter part having a tubular shape with a predetermined diameter to allow air to flow into the filter part from the air inlet and through the filter, wherein the air which is filtered through the filter is discharged to outside of the filter case through the air outlet.

16. The dryer according to claim 15, wherein the lint case is disposed on a front surface of the base.

17. The dryer according to claim 16, further comprising a lower cover detachably coupled to a lower portion of a front surface of the cabinet, wherein the lint case is covered by the lower cover.

18. The dryer according to claim 16, wherein the filter unit further comprises:

a front cover that defines a front surface of the filter case, wherein the air inlet is defined in an upper side of the filter case, the air outlet is defined in a back surface of the filter case, and the foreign substance discharge hole is defined in a lower side of the filter case.

19. The dryer according to claim 18, further comprising a housing disposed between the air duct and the lint case to guide air passing through the filter unit to the passage within the base.

20. The dryer according to claim 19, wherein a hole that communicates with the passage within the base is defined at a predetermined position of a back surface of the housing.

21. The dryer according to claim 19, wherein at least portion of the filter unit is received into the housing.

22. The dryer according to claim 19, wherein a foreign substance dropping hole is defined in a bottom surface of the housing, and the filter unit and the lint case communicate with each other through the foreign substance dropping hole.

23. The dryer according to claim 22, wherein the foreign substance dropping hole is defined right below the foreign substance discharge hole of the filter case.

24. The dryer according to claim 15, further comprising a lint case receiving part defined in a front surface of the base, wherein a hook part that prevents the lint case from being inadvertently separated is disposed on an inner circumference surface of the lint case receiving part.

25. The dryer according to claim 24, wherein the lint case receiving part has a shape in which a portion of the base is depressed or a rib shape protruding from the front surface of the base to surround the lint case.

26. A dryer, comprising:

a cabinet that defines an outer appearance of the dryer;

a drum inside the cabinet, the drum being configured to receive an object to be dried;

a drum cover having a hole through which the object is received, the drum cover supporting a front surface of the drum;

a base, on which a driving motor that generates a driving force to rotate the drum is seated, the base being disposed below the drum;

a filter unit within the drum cover, that filters foreign substances contained in moist air exhausted from the drum;

a fan assembly that generates airflow in a direction opposite to a flow direction of the moist air generated during a drying process to separate the foreign substances attached to the filter unit, wherein the filter unit comprises:

a filter case comprising an air inlet defined in an upper side thereof, an air outlet defined in a back surface thereof, and a foreign substance discharge hole defined in a lower side thereof;

a front cover that defines a front surface of the filter case; and a filter part within the filter case, the filter part having a tubular shape with an empty space therein, wherein a shield part having a shape corresponding to an outer appearance of the filter part protrudes from a back surface of the front cover.

* * * * *